US011480077B2

(12) United States Patent
Asami

(10) Patent No.: US 11,480,077 B2
(45) Date of Patent: Oct. 25, 2022

(54) OIL PAN

(71) Applicant: HONDA MOTOR CO., LTD., Tokyo (JP)

(72) Inventor: Takashi Asami, Saitama (JP)

(73) Assignee: HONDA MOTOR CO., LTD., Tokyo (JP)

( * ) Notice: Subject to any disclaimer, the term of this patent is extended or adjusted under 35 U.S.C. 154(b) by 15 days.

(21) Appl. No.: 17/136,521

(22) Filed: Dec. 29, 2020

(65) Prior Publication Data

US 2021/0207503 A1 Jul. 8, 2021

(30) Foreign Application Priority Data

Jan. 7, 2020 (JP) ..... JP2020-000831

(51) Int. Cl.
*F01M 11/00* (2006.01)

(52) U.S. Cl.
CPC ... *F01M 11/0004* (2013.01); *F01M 2011/002* (2013.01); *F01M 2011/0054* (2013.01); *F01M 2011/0058* (2013.01)

(58) Field of Classification Search
CPC ..... F01M 11/0004; F01M 2011/002; F01M 2011/0054; F01M 2011/0058
USPC ..... 123/196 R
See application file for complete search history.

(56) References Cited

U.S. PATENT DOCUMENTS

2004/0079318 A1* 4/2004 Batzill ..... F01M 11/0004 123/195 C
2011/0073062 A1* 3/2011 Nakashima ..... F01M 11/0004 123/195 C

FOREIGN PATENT DOCUMENTS

| | | | |
|---|---|---|---|
| JP | H0763300 | A | 3/1995 |
| JP | H08144848 | A | 6/1996 |
| JP | 2004353506 | A | 12/2004 |
| JP | 2008150974 | A | 7/2008 |
| JP | 2009185651 | A | 8/2009 |

OTHER PUBLICATIONS

Notice of Reasons for Refusal for Patent Application JP 2020000831; 8 pp.

* cited by examiner

*Primary Examiner* — Lindsay M Low
*Assistant Examiner* — Omar Morales
(74) *Attorney, Agent, or Firm* — Armstrong Teasdale LLP

(57) ABSTRACT

To achieve an improved rigidity, the an oil pan (3) for forming a lower end part of an internal combustion engine (1) comprises a bottom wall (6) and a side wall (7) extending from a peripheral edge of the bottom wall, wherein the bottom wall includes a pair of first planar surface portions (35) extending in a lateral direction and provided on either end of the bottom wall with respect to a fore and aft direction orthogonal to the lateral direction, and a curved surface portion (36) recessed downward with respect to the first planar surface portions.

8 Claims, 11 Drawing Sheets

1
65
65A
63
65B
66
58
51
51A
51B
24
56B
57
54A
52C
52B
52
51C
51D
54
54B
17
8
6
4
27
2
9
24
12
3
7
up
down
front
rear up
front
rear
down 3
44
24
25
7
13
45
27
47
47A
16
47B
18
17
6

OIL PAN

TECHNICAL FIELD

The present invention relates to an oil pan for an internal combustion engine.

BACKGROUND ART

The oil pan is known as a box shaped member having an open top, and forming a lower end part of an internal combustion engine. A known oil pan is provided with an arcuate bottom wall having a convex side facing downward for increasing the rigidity of the oil pan. See JP2009-185651A, for instance.

When the rigidity of the oil pan is desired to be increased even further, forming the bottom wall in an arcuate shape may not be adequate.

SUMMARY OF THE INVENTION

In view of such a problem of the prior art, a primary object of the present invention is to provide an oil pan having an improved rigidity.

To achieve such an object, the present invention provides an oil pan (3) for forming a lower end part of an internal combustion engine (1), comprising a bottom wall (6) and a side wall (7) extending from a peripheral edge of the bottom wall, wherein the bottom wall includes a pair of first planar surface portions (35) extending in a lateral direction and provided on either end of the bottom wall with respect to a fore and aft direction orthogonal to the lateral direction, and a curved surface portion (36) recessed downward with respect to the first planar surface portions.

The bottom wall is formed by a plurality of different surface portions including the two first planar surface portions and the curved surface portion so that the rigidity of the bottom wall can be increased.

Preferably, the curved surface portion has an arcuate cross section as viewed from the lateral direction.

Thereby, the rigidity of the curved surface portion can be increased.

Preferably, at least one of the first planar surface portions has a fore and aft width that progressively decreases toward a first side with respect to the lateral direction. Preferably, the side wall includes a first side wall provided in a front side part of the bottom wall, and a second side wall provided in a rear side part of the bottom wall, at least one of the first side wall and the second side wall being slanted inward toward the first side with respect to the lateral direction.

Since the width of the bottom wall is progressively reduced toward the first side with respect to the lateral direction or the lengthwise direction of the oil pan, the rigidity of the bottom wall can be improved.

Preferably, the side wall is provided with a fastening portion (47) on the first side thereof with respect to the lateral direction for fastening a transmission device or a drive unit thereto.

Thus, the rigidity of the first planar surface portions and the curved surface portion arranged on the first side with respect to the lengthwise direction of the oil pan can be improved owing to the presence of the fastening portion.

Preferably, at least one of the first planar surface portions is inclined downward toward the curved surface portion.

Thereby, the volume of the oil pan can be increased at the same time as increasing the rigidity of the bottom wall.

Preferably, the bottom wall includes a shallow bottom wall (16) provided on the first side with respect to the lateral direction, a deep bottom wall (17) provided on the second side with respect to the lateral direction and offset downward from the shallow bottom wall, and a connecting wall (18) provided between the shallow bottom wall and the deep bottom wall and inclined downward from the shallow bottom wall toward the deep bottom wall, the first planar surface portions and the curved surface portion being provided in the shallow bottom wall.

Preferably, the curved surface portion is provided with a reinforcing structure (38) that is recessed radially outward of the curved surface portion.

Thereby, the rigidity of the curved surface portion can be increased.

Preferably, the reinforcing structure extends laterally and is connected to the connecting wall.

Thereby, the rigidity of the curved surface portion can be increased even further.

Preferably, the shallow bottom wall includes a second planar surface portion (48) provided on the first side of the curved surface portion with respect to the lateral direction, and positioned above a lowermost part of the curved surface portion and below a lowermost part of the first planar surface portions.

Thereby, the rigidity of the shallow bottom wall can be increased.

The present invention thus provides an oil pan having an improved rigidity.

BRIEF DESCRIPTION OF THE DRAWING(S)

DESCRIPTION OF THE PREFERRED EMBODIMENT(S)

An oil pan 3 for an internal combustion engine 1 according to an embodiment of the present invention is described in the following with reference to the appended drawings. The oil pan is a component part that forms the lower end part of the internal combustion engine. In the following description, it is assumed that the internal combustion engine is mounted laterally on the vehicle, and it should be understood that the directions such as the lateral direction and the fore and aft direction used in the following disclosure will be based on the mounted state of the internal combustion engine 1.

Figure 1:
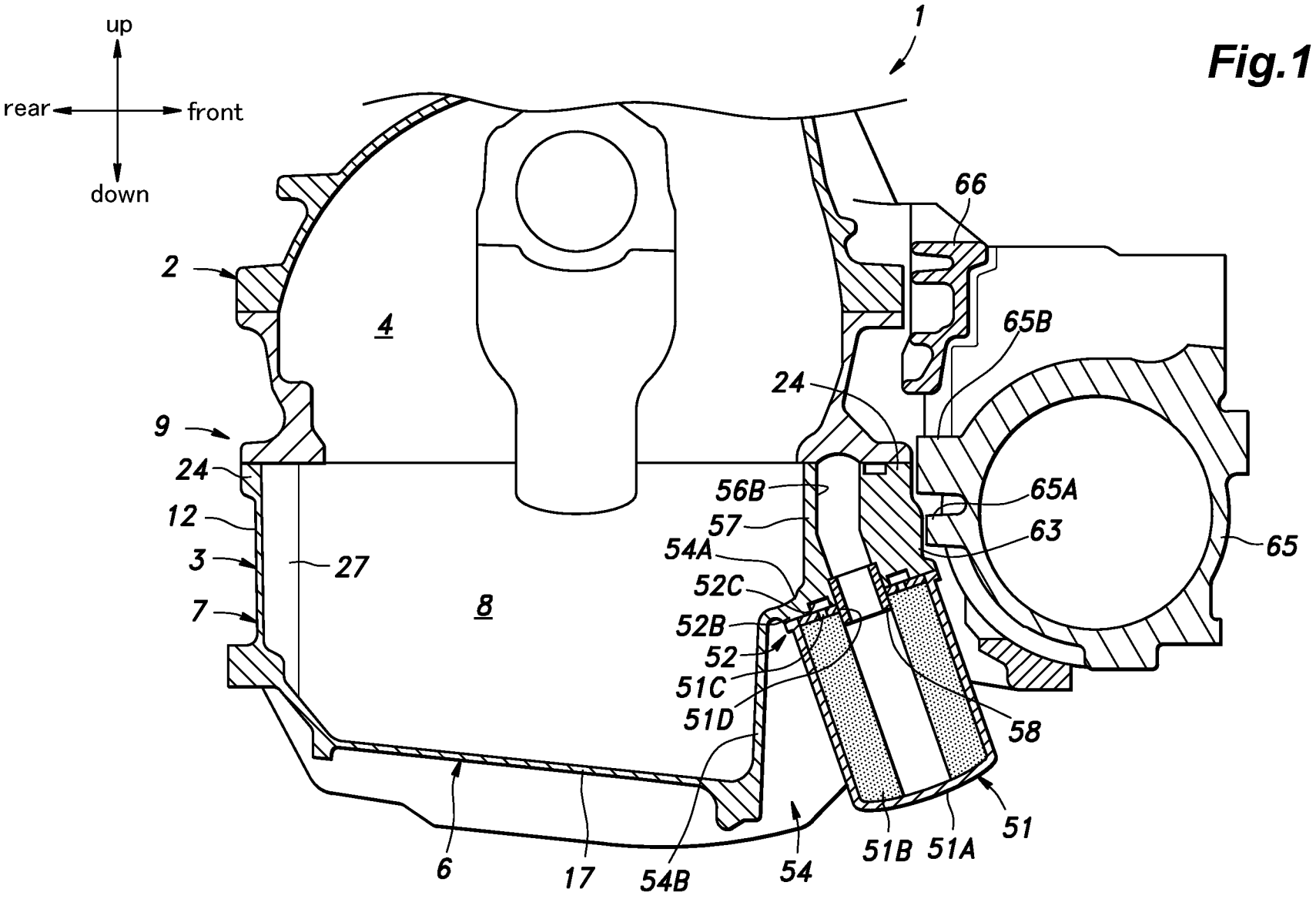
FIG. 1 is a cross sectional view of an internal combustion engine according to an embodiment of the present invention taken along line I-I of FIG. 3.

As shown in FIG. 1, the internal combustion engine 1 is provided with an engine block 2 and an oil pan 3 attached to the lower end of the engine block 2. The engine block 2 is a component forming the main body of the internal combustion engine 1, and includes a cylinder block, a crankcase, and a lower block in a per se known manner. The cylinder block, crankcase and lower block may be formed integrally, or may be formed separately and combined with each other. Further, the lower block may be formed as a part of the crankcase. A crank chamber 4 that has an open side facing downward is formed in a lower end part of the engine block 2. A crankshaft is rotatably supported by the crankcase, and positioned in the crank chamber 4. A piston received by each cylinder formed in the cylinder block is connected to the crankshaft via a connecting rod in a per se known manner.

Figure 2:
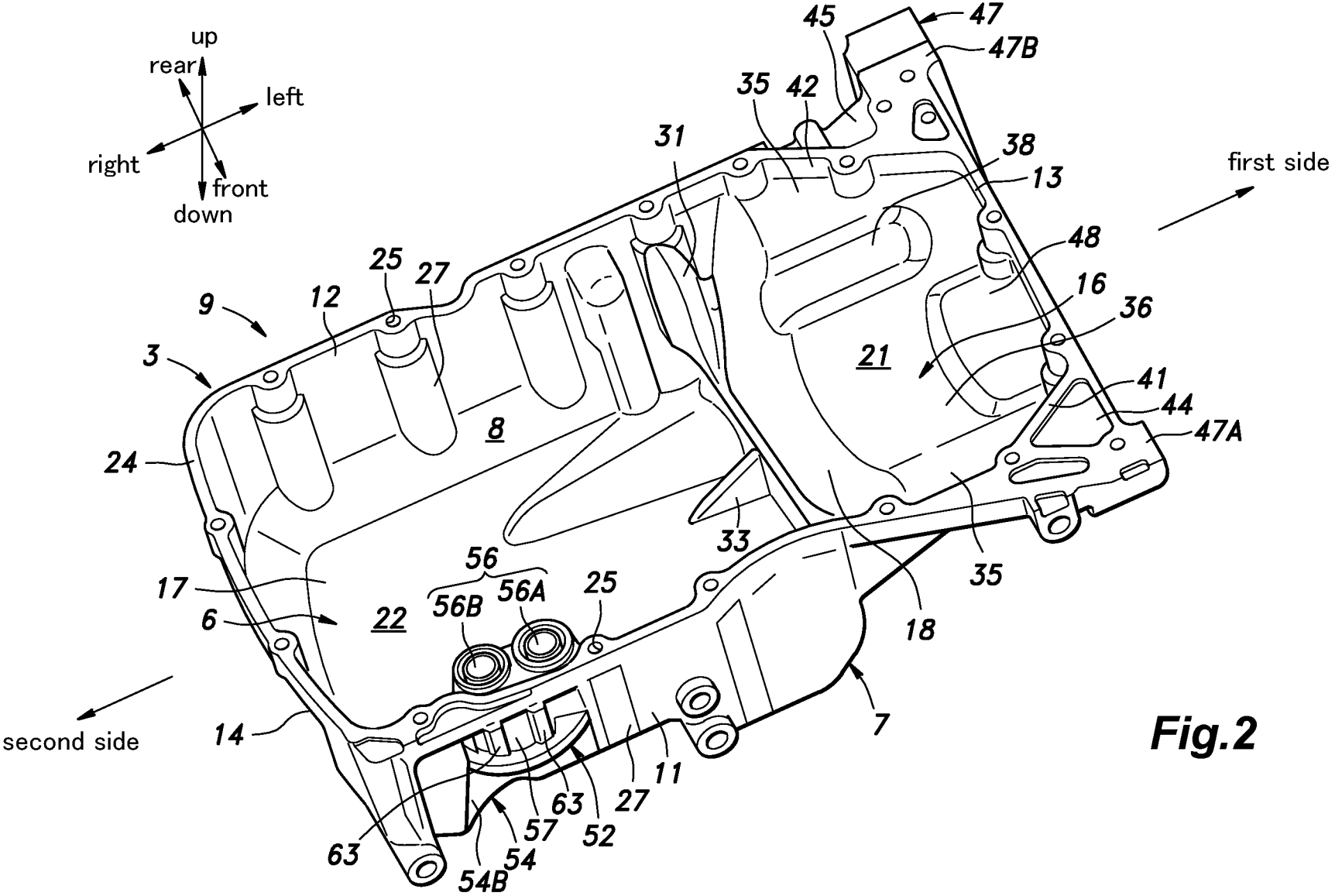
FIG. 2 is a perspective view of the oil pan.
Figure 3:
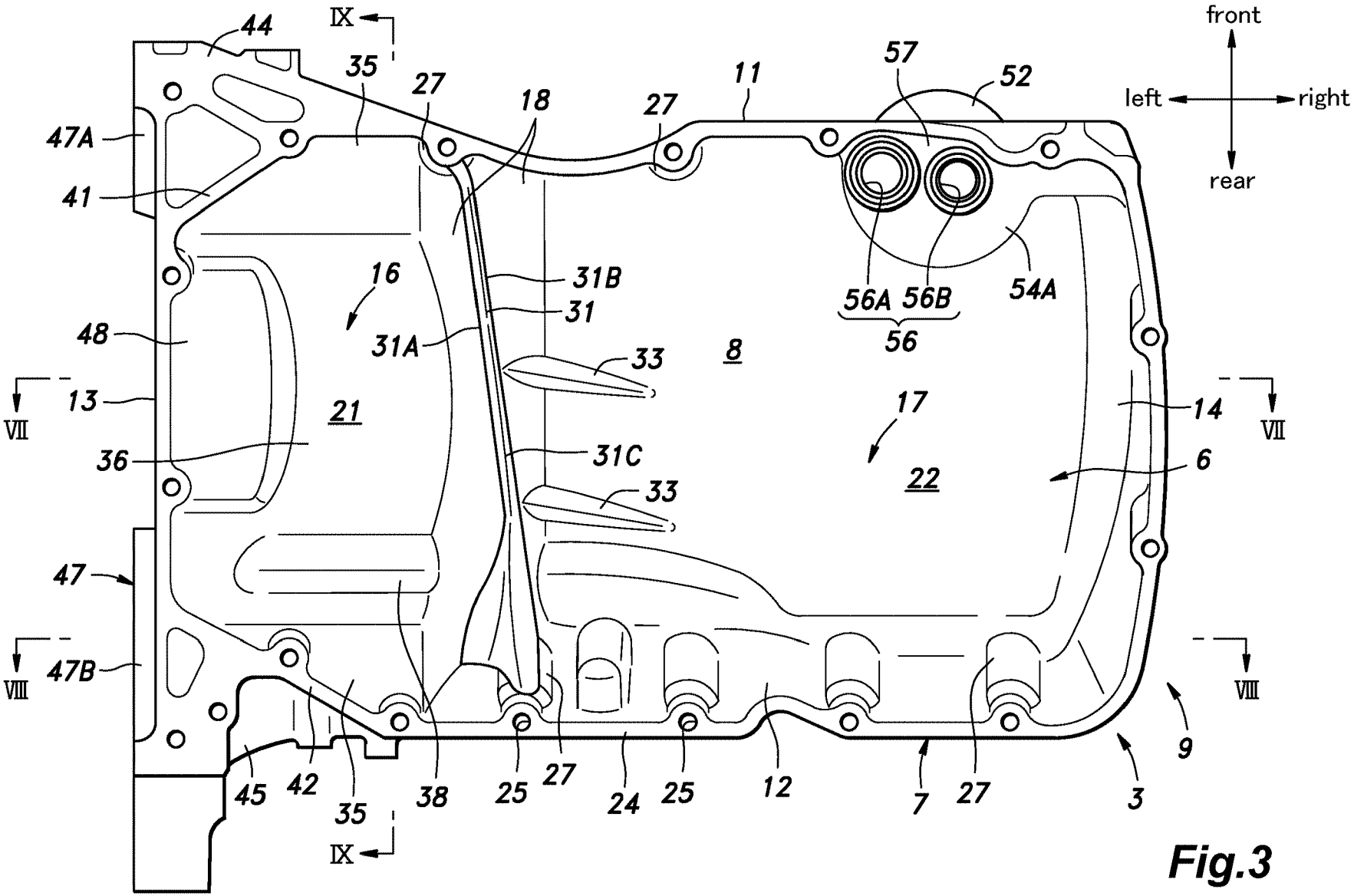
FIG. 3 is a plan view of the oil pan.

As shown in FIGS. 2 and 3, the oil pan 3 includes a bottom wall 6 and a side wall 7 extending substantially upward from the peripheral edge of the bottom wall 6. The side wall 7 is provided in an annular shape along the edge of the bottom wall 6 in an annular fashion, and defines a rectangular box-shaped space or an oil chamber 8 that opens upward in cooperation with the bottom wall 6. The oil chamber 8 communicates with the crank chamber 4. The engine block 2 and the oil pan 3 form a lower structure 9 of the internal combustion engine 1. The oil pan 3 is formed, for example, by casting. The oil pan 3 extends in the lateral direction and the fore and aft direction. In the illustrated embodiment, the internal combustion engine 1 is mounted laterally on the vehicle body. However, the present invention is equally applicable to the case where the internal combustion engine 1 is mounted longitudinally or in the fore and aft direction.

The bottom wall 6 is formed in a substantially rectangular shape elongated in the lateral direction in plan view. Thus, the two long sides of the bottom wall 6 extend laterally and the two short sides extend in the fore and aft direction. The lateral direction of the oil pan 3 is parallel to the axial direction of the crankshaft.

The side wall 7 is provided along the peripheral edge of the substantially rectangular bottom wall 6, and is formed in a square tubular shape. The side wall 7 includes a first side wall 11 provided on the front side of the bottom wall 6, and a second side wall 12 provided on the rear side of the bottom wall 6. Further, the side wall 7 includes a third side wall 13 provided on the laterally first side (left side) of the bottom wall 6, and a fourth side wall 14 provided on the laterally second side (right side) of the bottom wall 6. In the present embodiment, the laterally first side corresponds to the left side with respect to the vehicle, and the laterally second side corresponds to the right side of the vehicle. The first side wall 11 and the second side wall 12 extend in the lateral direction along the bottom wall 6, and the third side wall 13 and the fourth side wall 14 extend in the fore and aft direction along the bottom wall 6. The first side wall 11, the third side wall 13, the second side wall 12, and the fourth side wall 14 are continuous in an annular shape.

The bottom wall 6 includes a shallow bottom wall 16 provided laterally on the first side or on the left side, a deep bottom wall 17 offset downwardly relative to the shallow bottom wall 16, and provided laterally on the second side or on the right side, and a connecting wall 18 provided between the shallow bottom wall 16 and the deep bottom wall 17 and inclined downward from the shallow bottom wall 16 toward the deep bottom wall 17. Thus, the space in the oil pan 3 includes a shallow bottom portion 21 corresponding to the shallow bottom wall 16 and a deep bottom portion 22 corresponding to the deep bottom wall 17. The depth of the oil pan 3 is thus deeper in the deep bottom portion 22 than in the shallow bottom portion 21.

The oil pan 3 is provided with a flange 24 extending along the upper edge of the side wall 7. The flange 24 extends outwardly from the upper edge of the side wall 7 at substantially right angle to the side wall 7. The upper surface of the flange 24 is formed flat, and abuts against the lower surface of the engine block 2. A plurality of bolt insertion holes 25 are passed vertically through the flange 24. The oil pan 3 is fastened to the engine block 2 by passing a plurality of bolts through these bolt insertion holes 25 from below, and threading them into corresponding screw holes formed on the lower surface of the engine block 2. Thus, the oil pan 3 closes the lower end of the crank chamber 4 from below.

The side wall 7 is provided with a plurality of bolt receiving portions 27 so as to correspond to the respective bolt insertion holes 25. Each bolt receiving portion 27 is formed as a thick wall portion of the corresponding part of the side wall 7 bulging inwardly of the oil pan 3, and extends vertically from the flange 24 to the bottom wall 6.

The outer surface of the part of the side wall 7 corresponding to each bolt receiving portion 27 is substantially flat, and is smoothly connected to the adjacent part of the outer surface of the side wall 7. The bolt receiving portion 27 thus has a semicircular cross section when viewed from the vertical direction. The bolt receiving portion 27 provides the material for defining a hole through which the bolt is passed upward into the corresponding bolt insertion hole 25. Further, the bolt receiving portions 27 serve as vertically extending reinforcing ribs for increasing the side wall 7 (the first to fourth side walls 11 to 14).

Figure 7:
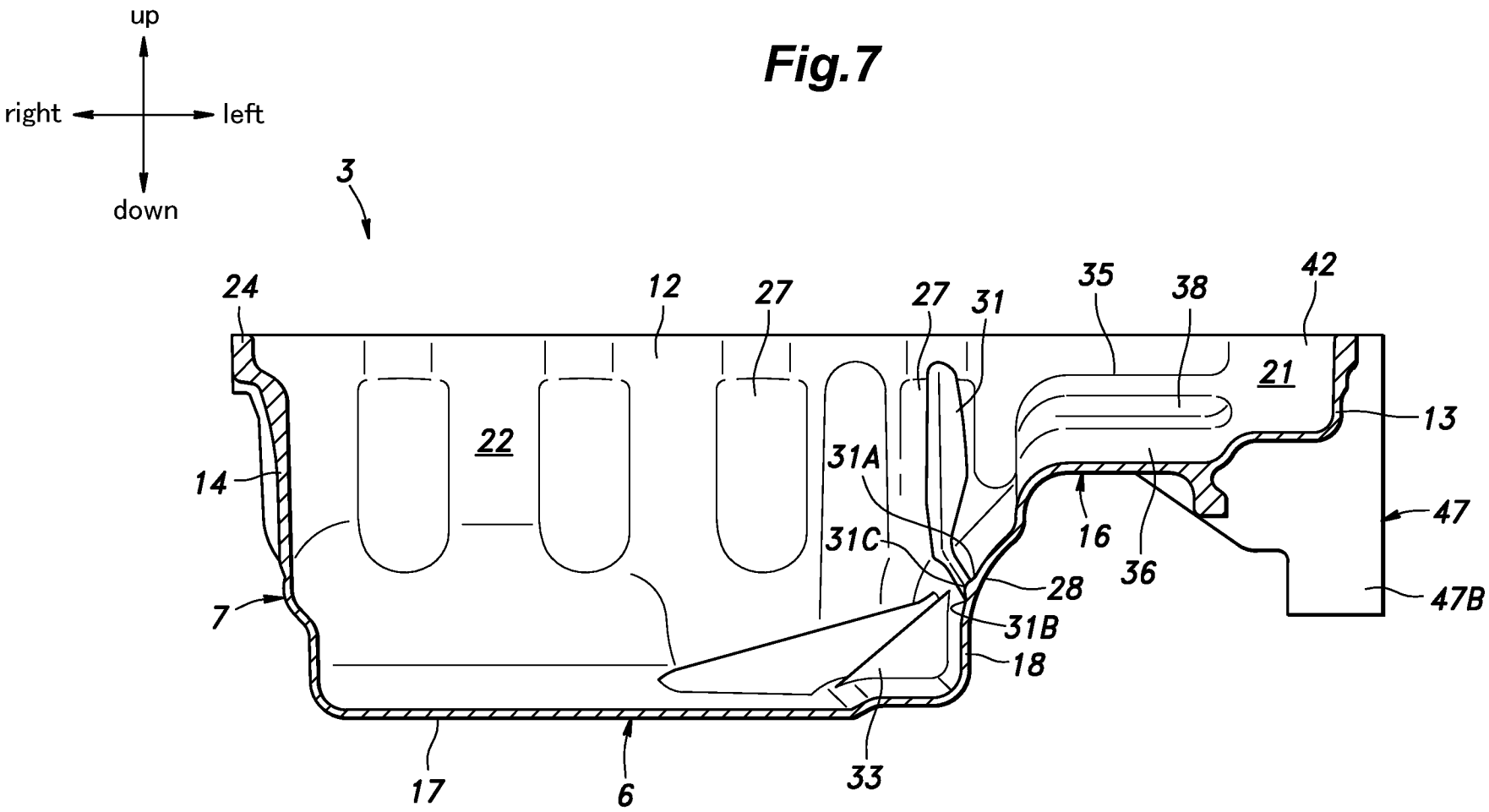
FIG. 7 is a sectional view taken along line VII-VII of FIG. 3.

As shown in FIG. 7, the connecting wall 18 includes a curved surface portion 28 having a convex side facing inwardly of the oil pan 3, or toward the second side in the lateral direction. More specifically, the curved surface portion 28 has a convex side facing toward the second side when viewed in the fore and aft direction.

As shown in FIGS. 2, 3, 7, and 8, the connecting wall 18 is provided with a first rib 31 extending in the fore and aft direction and connected to the first side wall 11 and the second side wall 12 at respective end parts thereof. The first rib 31 consists of a single continuous rib. The first rib 31 is a solid rib and projects from the connecting wall 18 toward the inside of the oil pan 3. The outer surface of the connecting wall 18 corresponding to the first rib 31 is formed as a flat surface smoothly connected to the adjacent part.

The amount of protrusion of an intermediate part of the first rib 31 with respect to the fore and aft direction from the inner surface of the connecting wall 18 is smaller than that of the end parts thereof. The projecting end of the intermediate part of the first rib 31 is positioned below the shallow bottom wall 16. The end parts of the first rib 31 project somewhat upward from the connecting wall 18. The amount of protrusion of the first rib 31 with respect to the general surface of the connecting wall 18 progressively and continuously decreases from the two end parts to the intermediate part. In another embodiment, the amount of protrusion of the first rib 31 decreases from the two end parts to the intermediate part in a progressive and stepwise manner. The first rib 31 thus increase the rigidity of the connecting wall 18 without obstructing the flow of oil from the shallow bottom wall 16 to the deep bottom wall 17. Further, the first rib 31 functions as a brace connecting the connecting wall 18 with the first side wall 11 and the second side wall 12 to increase the rigidity of the oil pan 3. The first rib 31 mainly increases the rigidity of the oil pan 3 against twisting deformation thereof around the lateral axis of the oil pan 3.

The projecting direction of the first rib 31 differs along the fore and aft direction. The intermediate part of the first rib 31 projects laterally, or toward the second side in the lateral direction of the bottom wall 6. The two end parts of the first rib 31 project in a more upwardly direction. The projecting direction of the first rib 31 progressively changes toward the upward direction from the intermediate part to the two end parts. The first rib 31 is bounded from the connecting wall 18 by an upper boundary 31A and a lower boundary 31B, and the intermediate part of the first rib 31 slants downward from the upper boundary 31A to the projecting end 31C thereof. Thereby, the intermediate part of the first rib 31 is prevented from obstructing the flow of oil from the shallow bottom wall 16 to the deep bottom wall 17.

One end of the first rib 31 is connected to one of the bolt receiving portions 27 provided on the first side wall 11. Further, the other end of the first rib 31 is connected to another of the bolt receiving portions 27 provided on the second side wall 12. The bolt receiving portions 27 in the first side wall 11 and the second side wall 12 have a higher rigidity than the remaining part of the side wall 7. Therefore, by connecting the first rib 31 to the bolt receiving portions 27, the rigidity of the first rib 31 is increased so that the rigidity of the connecting wall 18 is particularly increased. It is preferable that the both ends of the first rib 31 are connected to the upper ends of the respective bolt receiving portions 27. Further or alternatively, the end portions of the first rib 31 are connected to the upper end portions of the respective bolt receiving portion 27 and/or the flange 24.

The bolt receiving portion 27 to which the corresponding end portion of the first rib 31 is connected on the side of the first side wall 11 has an upper end connected to the connecting wall 18 while the most part of the bolt receiving portion 27 is connected to the first side wall 11. The bolt receiving portion 27 to which the corresponding end portion of the first rib 31 is connected on the side of the second side wall 12 has a lower end connected to the connecting wall 18 while the most part of the bolt receiving portion 27 is connected to the second side wall 12. By thus connecting the bolt receiving portions 27 to the connecting wall 18, the rigidity of the connecting wall 18 can be increased. The first rib 31 is directly connected to the bolt receiving portions 27 from the side of the connecting wall 18. The bolt receiving portion 27 to which the first rib 31 is connected on the side of the first side wall 11 is preferably offset in the lateral direction with respect to the bolt receiving portion 27 to which the first rib 31 is connected on the side of the second side wall 12. As a result, the first rib 31 is at an angle with respect to the fore and aft direction in plan view.

The first rib 31 passes through the curved surface portion 28 of the connecting wall 18. As a result, the rigidity of the curved surface portion 28 increases, and the rigidity of the connecting wall 18 increases.

The deep bottom wall 17 is provided with a pair of second ribs 33 that project upward. One end of each second rib 33 is connected to the connecting wall 18. Each second rib 33 extends laterally, and the projecting amount progressively increases toward the connecting wall 18. Each second rib 33 is formed in a triangular shape when viewed from the fore and aft direction. There may be only one second rib 33, or three or more second ribs 33 may be provided. The second ribs 33 function as braces that connect the deep bottom wall 17 with the connecting wall 18, and increase the rigidity of the deep bottom wall 17 and the connecting wall 18.

Figure 9:
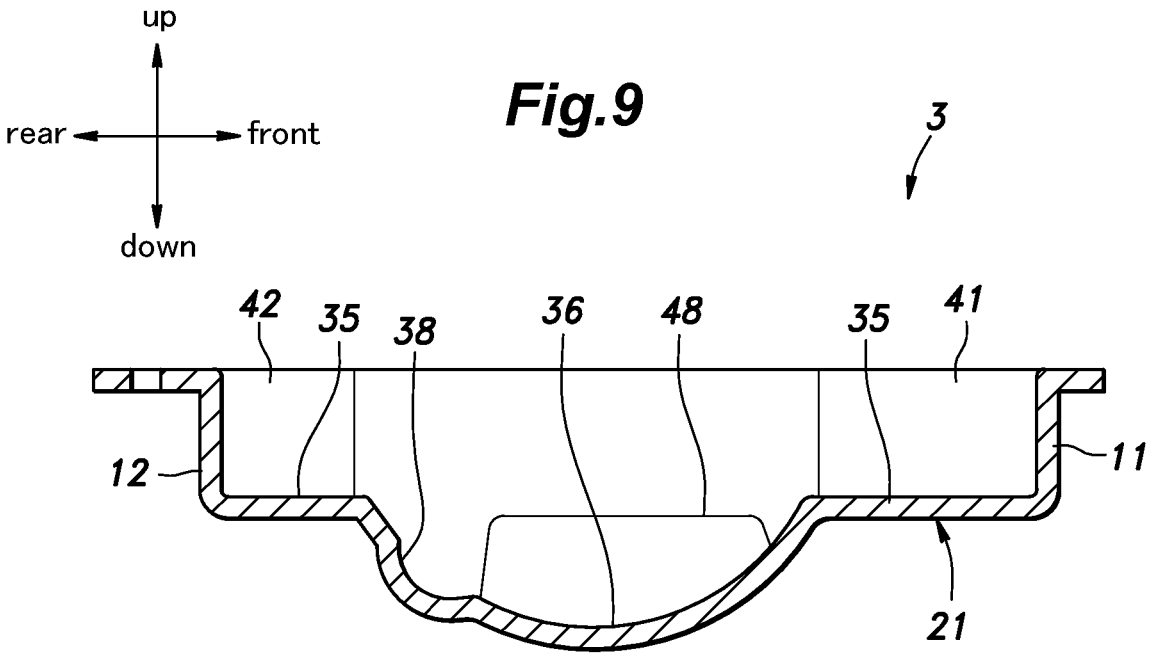
FIG. 9 is a sectional view taken along line IX-IX of FIG. 3.
Figure 10:
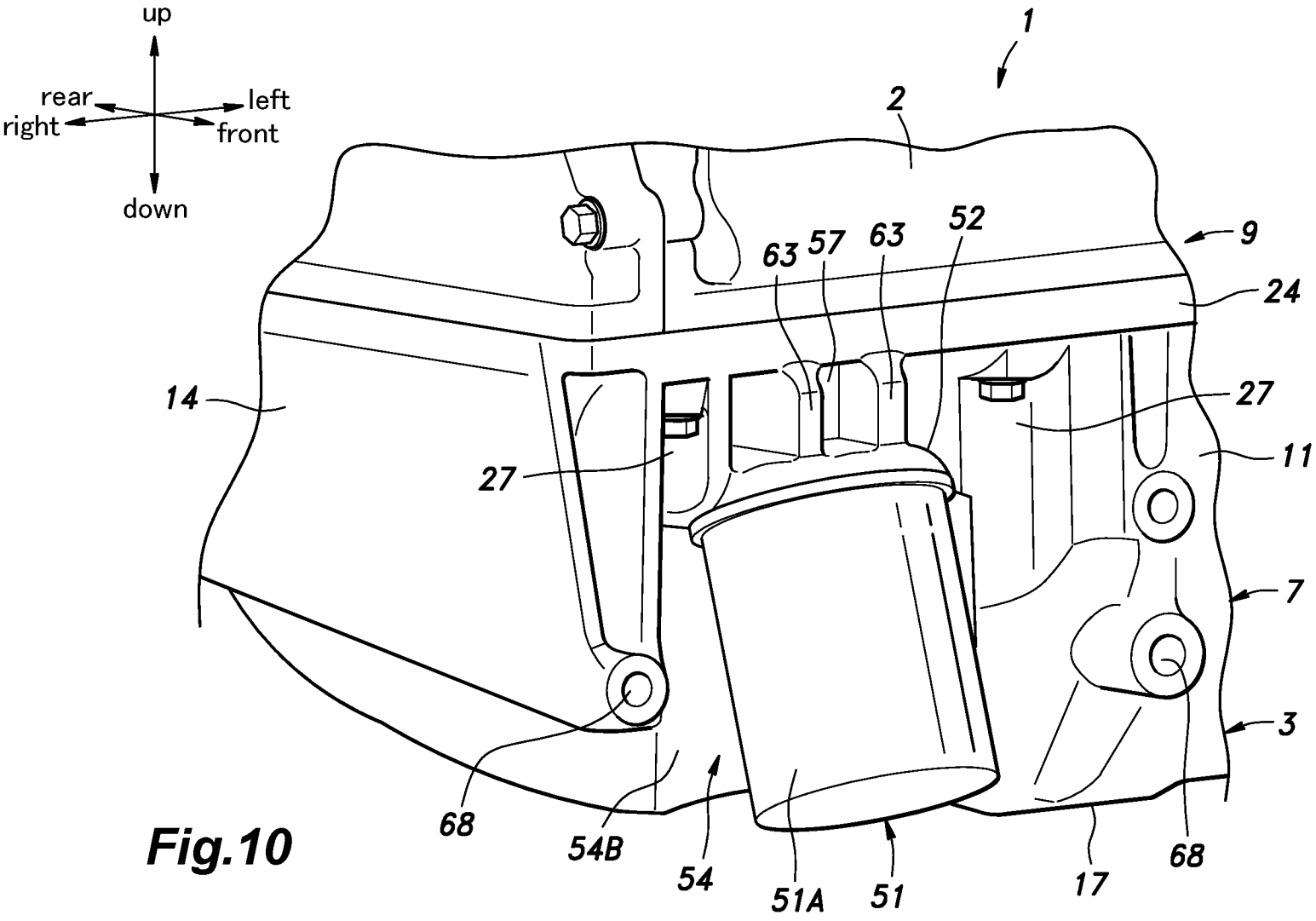
FIG. 10 is a perspective view of the oil pan with an oil filter installed.

As shown in FIGS. 2, 3 and 9, the bottom wall 6 includes a pair of first planar surface portions 35 provided at the two ends of the bottom wall 6 with respect to the fore and aft direction or the front end and the rear end of the bottom wall 6, respectively, and a curved surface portion 36 which is recessed downward relative to the first planar surface portions 35 and located between the two first planar surface portions 35. In the illustrated embodiment, the curved surface portion 36 has a substantially part-cylindrical profile having an axial line extending in the lateral direction. The first planar surface portions 35 and the curved surface portion 36 may be provided in at least one of the shallow bottom wall 16 and the deep bottom wall 17. In the present embodiment, the first planar surface portions 35 and the curved surface portions 36 are provided in the shallow bottom wall 16. The description of the first planar surface portions 35 and the curved surface portion 36 as provided in the shallow bottom wall 16 may be applied to the case where the first planar surface portions 35 and the curved surface portion 36 as provided in the deep bottom wall 17 with suitable changes.

The first planar surface portions 35 and the curved surface portion 36 are extended in the lateral direction of the bottom wall 6. The first planar surface portions 35 and the curved surface portion 36 are connected to the connecting wall 18. More specifically, the upper edge of the connecting wall 18 is formed by the first planar surface portions 35 and curved surface portions 36.

The curved surface portion 36 demonstrates an arcuate profile when viewed from the lateral direction. The curved surface portion 36 is provided with a reinforcing feature 38 that is recessed downward, or radially outward of (the arcuate profile of) the curved surface portion 36. The reinforcing feature 38 extends laterally along the bottom wall 6 in a region where the curved surface portion 36 adjoins the planar surface portion 35 on the rear side or on the side of the second side wall 12, and is connected to the connecting wall 18. The end of the reinforcing feature 38 on the first side is spaced from the third side wall 13. The cross section of the reinforcing feature 38 is formed in a semicircular shape. The reinforcing feature 38 may be arranged centrally in the curved surface portion 36, but is preferably offset from the center of the curved surface portion 36 toward one of the first planar surface portions 35. In the present embodiment, the reinforcing feature 38 is offset toward the rear side with respect to the center of the curved surface portion 36.

At least one of the first planar surface portions 35 is inclined downward toward the side of the curved surface portion 36. Both of the first planar surface portions 35 may be inclined downward toward the side of the curved surface portion 36. Further, the first planar surface portions 35 may be arranged in planes that are parallel with each other. Alternatively, the first planar surface portions 35 may be arranged on the same plane.

The width of at least one of the first planar surface portions 35 in the fore and aft direction gets smaller toward the first side in the lateral direction. In the present embodiment, at least one of the first side wall 11 and the second side wall 12 is inclined inward of the oil pan 3 in plan view as one moves toward the first side in the lateral direction, so that the width of the at least one of the first planar surface portions 35 progressively decreases toward the first side. In the present embodiment, the first side wall 11 has a first inclined wall 41 at an end part thereof on the first side inclining inward toward the first side. In other words, the first inclined wall 41 is inclined toward the side of the second side wall 12 or rearward as one moves toward the first side in the lateral direction. Further, the second side wall 12 has a second inclined wall 42 at an end part thereof on the first side inclining inward toward the first side. In other words, the second inclined wall 42 is inclined toward the side of the first side wall 11 or forward as one moves toward the first side in the lateral direction.

A first expansion portion 44 projects outward from the outer surface of the first inclined wall 41. The first expansion portion 44 projects in a direction directed to the first side in the lateral direction, or to the left side and to the front side. A second expansion portion 45 projects outward from the outer surface of the second inclined wall 42. The second expansion portion 45 projects in a direction directed to the first side in the lateral direction, or to the left side and to the rear side. The upper surface of the first expansion portion 44 and the upper surface of the second expansion portion 45 are arranged on the same plane as the upper surface of the flange 24, and are continuous with the upper surface of the flange 24. The upper surface of the first expansion portion 44 and the upper surface of the second expansion portion 45 abut against the lower surface of the engine block 2. The first expansion portion 44 and the second expansion portion 45 are formed with a plurality of bolt insertion holes 25 through which bolts for fastening the oil pan 3 to the engine block 2 are passed.

Figure 4:
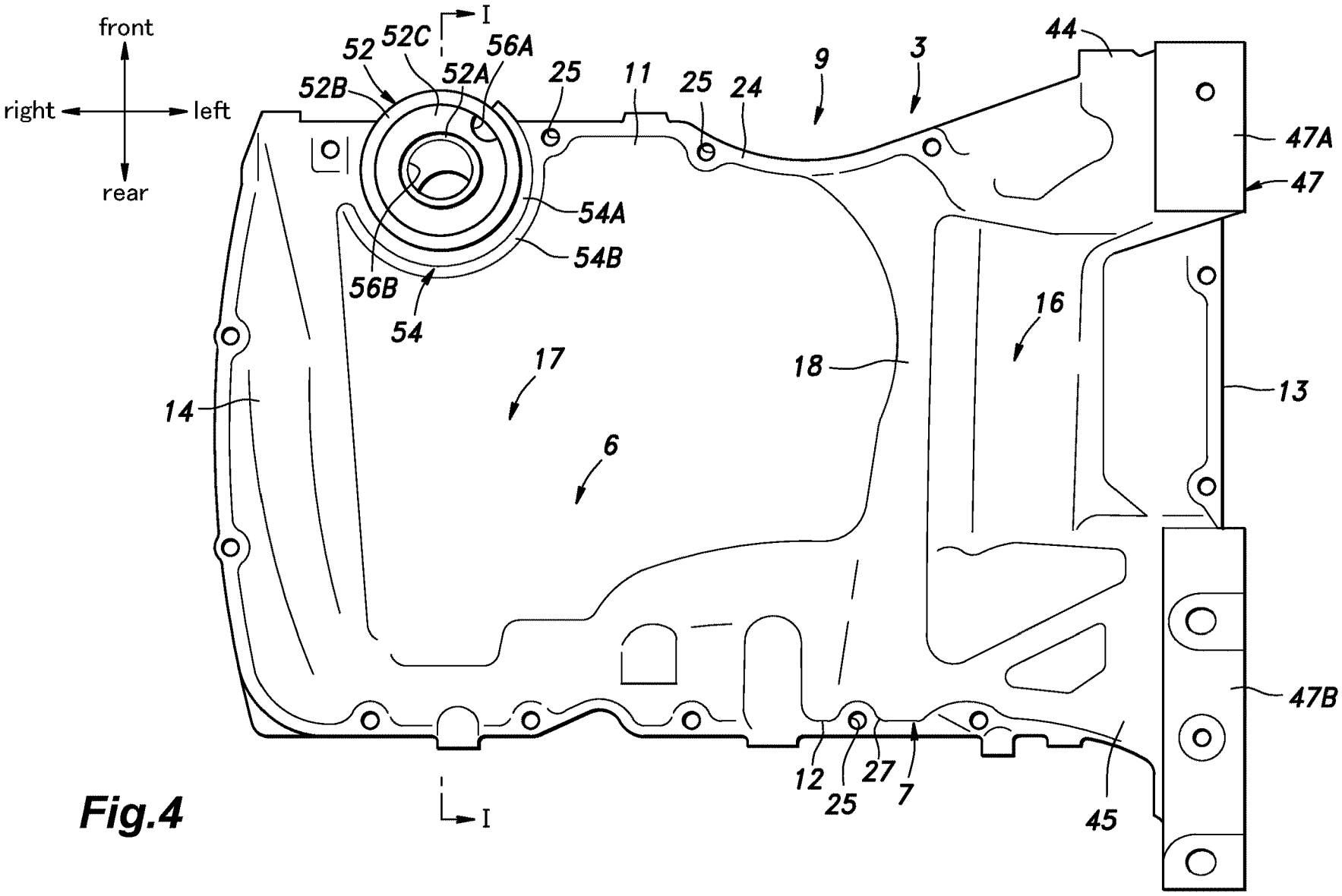
FIG. 4 is a bottom view of the oil pan.
Figure 6:
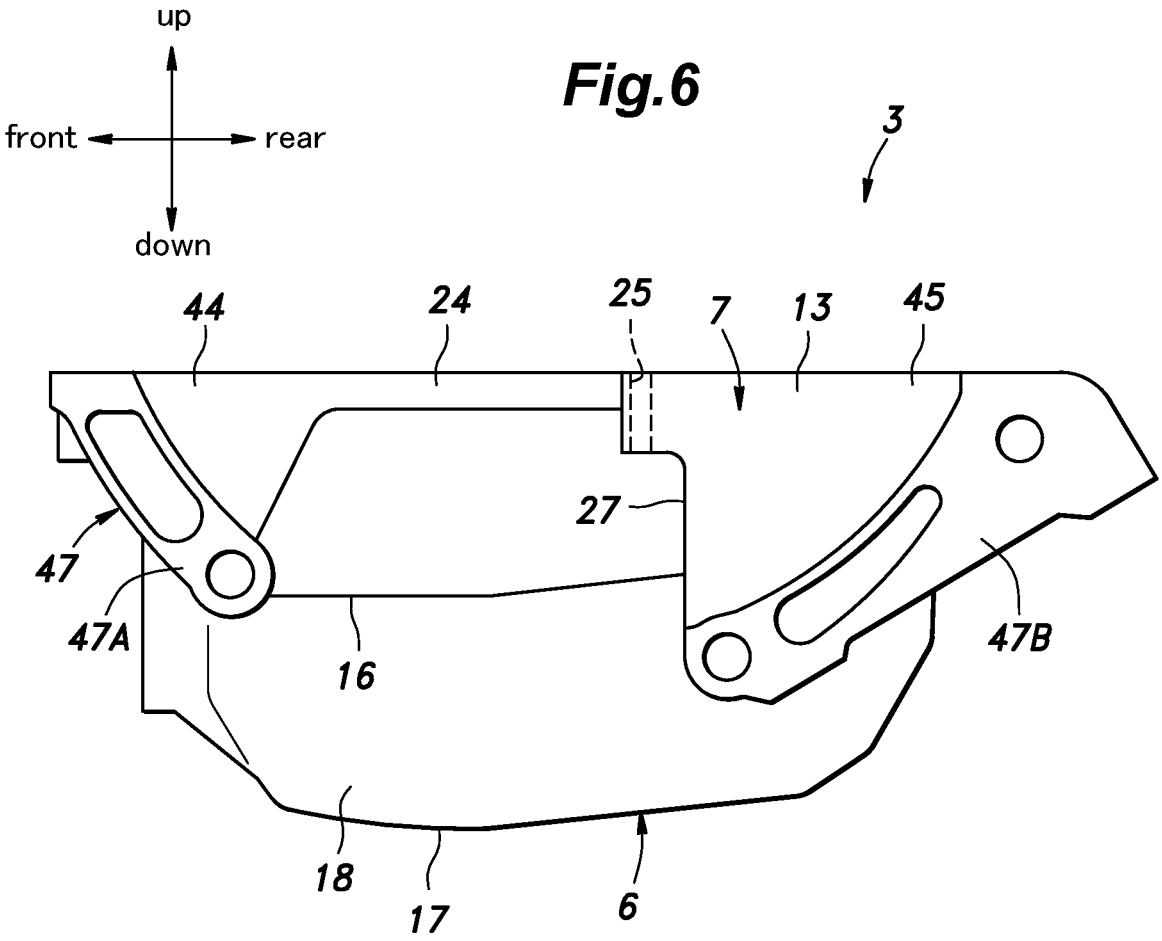
FIG. 6 is a left side view of the oil pan

As shown in FIGS. 3, 4 and 6, the side wall 7 is provided with a fastening portion 47 to be fastened to a transmission or a drive unit on the first side of the bottom wall 6 with respect to the lateral direction. The drive unit may consist of an electric motor, for example. The fastening portion 47 may be fastened to the case of the transmission or the case of the drive unit. The fastening portion 47 is formed on the third side wall 13, the first expansion portion 44, and the second expansion portion 45. The fastening portion 47 has a first fastening portion 47A extending downward from the first expansion portion 44 and extending toward the third side wall 13, and a second fastening portion 47B extending downward from the second expansion portion 45 and extending toward the third side wall 13. The first fastening portion 47A and the second fastening portion 47B are each provided with a fastening surface that abuts against the case of the transmission or the drive unit on the first side of the bottom wall 6 with respect to the lateral direction. The first fastening portion 47A and the second fastening portion 47B have a thickness in the lateral direction which is larger than the thickness of any other part of the side wall 7, the bottom wall 6, and the flange 24. Since the first inclined wall 41 is connected to the first fastening portion 47A via the first expansion portion 44, the rigidity of the first inclined wall 41 is increased. Similarly, since the second inclined wall 42 is connected to the second fastening portion 47B via the second expansion portion 45, the rigidity of the second inclined wall 42 is increased.

As shown in FIGS. 2, 3 and 9, the shallow bottom wall 16 further includes a second planar surface portion 48 on the first side (the left side) of the curved surface portion 36 with respect to the lateral direction. The second planar surface portion 48 extends substantially horizontally, and located above the lowermost part of the curved surface portion 36, and below the lowermost part of the first planar surface portions 35. In other words, the second planar surface portion 48 projects upward from the curved surface portion 36. The upper surface of the second planar surface portion 48 is generally flat, and is connected to the third side wall 13. The second planar surface portion 48 is spaced from the connecting wall 18. The second planar surface portion 48 introduces a three-dimensional feature into the curved surface portion 36 to increase the rigidity of the curved surface portion 36.

As shown in FIGS. 1 to 5, the side wall 7 is provided with a device mounting seat 52 to which a prescribed device is mounted. The prescribed device may be, for example, an oil filter for removing foreign matter from oil, a heat exchanger for heat exchange between oil and other fluids, a control valve for controlling the flow of oil, and the like. In this embodiment, the prescribed device consists of an oil filter 51. The device mounting seat 52 functions as an oil filter mounting seat to which the oil filter 51 is mounted. The oil filter 51 may be a per se known cartridge type oil filter. The oil filter 51 may include, as shown in FIG. 1, a cylindrical casing 51A, a filter element 51B received in the casing 51A, and an inlet passage 51C and an outlet passage 51D provided on one end surface of the casing 51A facing in the axial direction. The outlet passage 51D is provided centrally on the end surface of the casing 51A, and the inlet passage 51C is provided on a side part of the end surface of the casing 51A next to the outlet passage 51E. The oil supplied to the oil filter 51 passes through the inlet passage 51C, the filter element 51B, and the outlet passage 51D in this order and is discharged to the outside. As the oil passes through the filter element 51B, foreign matter in the oil is removed.

In the present embodiment, the device mounting seat 52 is provided on the first side wall 11 positioned on the front side of the oil pan 3. The first side wall 11A is formed with a device receiving portion 54 consisting of a recess configured to receive a part of the oil filter 51. More specifically, the device receiving portion 54 includes a planar upper wall 54A extending rearward from the first side wall 11, and a vertical wall 54B extending downward from the upper wall 54A. The upper wall 54A is formed in a substantially circular shape in a plan view. The vertical wall 54B extends in a part-cylindrical shape along the edge of the upper wall 54A so as to conform to the outer profile of the oil filter 51. The side edges of the vertical wall 54B are connected to the first side wall 11, and the lower edge of the vertical wall 54B is connected to the deep bottom wall 17. The device receiving portion 54 is thus a recess that opens forward and downward at the boundary between the first side wall 11 and the deep bottom wall 17. The lower surface of the upper wall 54A is planar and faces downward.

Figure 5:
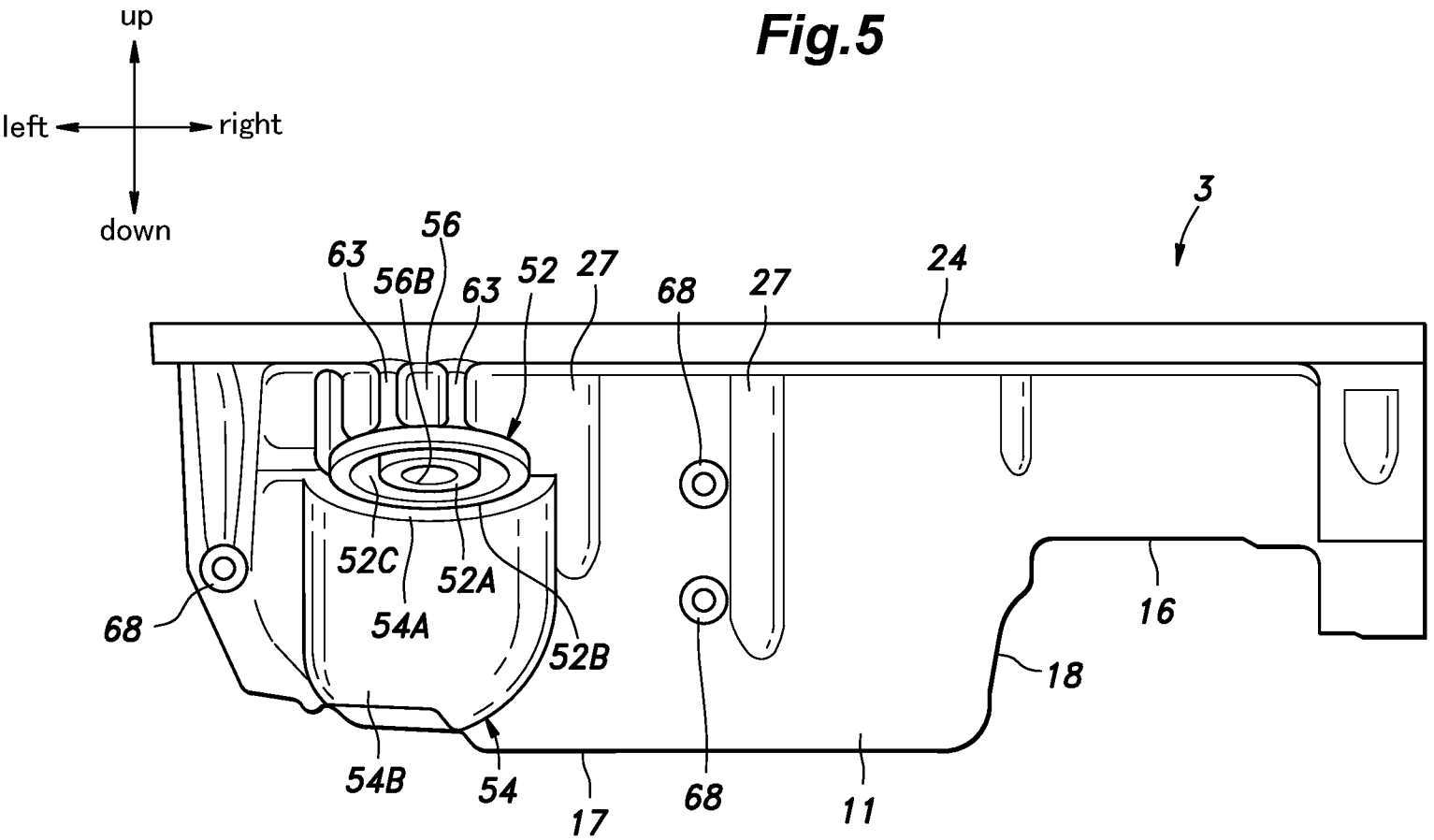
FIG. 5 is a front view of the oil pan.

As shown in FIGS. 4 and 5, the device mounting seat 52 is formed on the lower surface of the upper wall 54A. The device mounting seat 52 is a disk-shaped portion having a certain vertical thickness. The lower surface of the device mounting seat 52 is formed with a circular central contact portion 52A and an annular outer peripheral contact portion 52B concentrically surrounding the central contact portion 52A, and an annular groove 52C is formed between the central contact portion 52A and the outer peripheral contact portion 52B.

Figure 11:
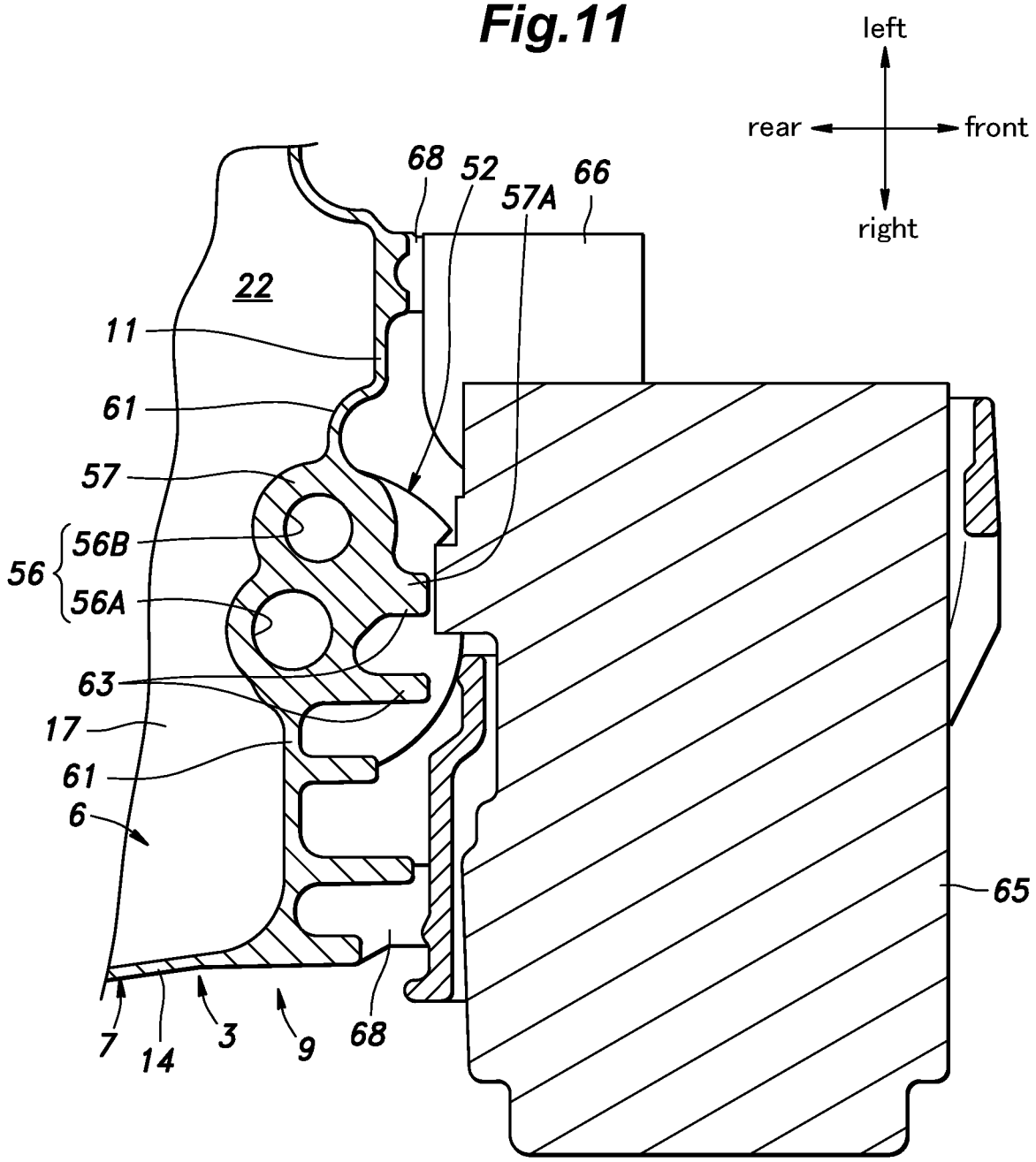
FIG. 11 is an enlarged fragmentary sectional view of the internal combustion engine showing an oil passage portion of the oil pan.

As shown in FIGS. 3 and 11, an oil passage portion 57 is formed in the first side wall 11 to define an oil passage 56 through which oil flows. The oil passage portion 57 has a larger wall thickness than the other portions of the first side wall 11. The oil passage 56 opens to the device mounting seat 52 and communicates with the interior of the oil filter 51. The oil passage 56 extends vertically, and the upper end of the oil passage 56 is positioned inwardly of the flange 24.

In the present embodiment, the oil passage 56 includes a supply passage 56A for supplying oil from the oil pump to the oil filter 51, and a return passage 56B for returning the oil from the oil filter 51 to the engine block 2. The supply passage 56A and the return passage 56B extend vertically next to and adjacent to each other. The lower end of the supply passage 56A is open to the bottom surface of the groove 52C of the device mounting seat 52. The lower end of the return passage 56B opens in the center of the central contact portion 52A. As shown in FIG. 1, a short connecting pipe 58 is inserted into and fixed at the lower end of the return passage 56B. One end of the connecting pipe 58 protrudes from the central contact portion 52A, and is formed with a male screw on the outer circumferential surface thereof. The oil filter 51 is fixed to the device mounting seat 52 by threading the one end of the connecting pipe 58 into the outlet passage 51D. At this time, the end surface of the oil filter 51 comes into contact with the central contact portion 52A and the outer peripheral contact portion 52B of the device mounting seat 52 via a seal member. As a result, the supply passage 56A is connected to the inlet passage 51C via the groove 52C, and the return passage 56B is connected to the outlet passage 51D via the connecting pipe 58.

The upper end of the supply passage 56A may be connected to the oil pump via an oil passage formed in the engine block 2, or may be connected to the oil pump by piping. The oil pump may be formed in the engine block 2. Further, the oil pump may also be formed in the casing of a balancer device arranged in the oil pan 3.

The upper end of the return passage 56B communicates with the oil passage formed in the engine block 2. The oil passage supplies oil to the sliding portions of the internal combustion engine 1 and the hydraulic system.

As shown in FIG. 11, the oil passage portion 57 includes a thick wall portion 57A located between the supply passage 56A and the return passage 56B and having a larger thickness than the surrounding part. The thick wall portion 57A fills the space created between the supply passage 56A and the return passage 56B, each having a circular cross section, and increases the rigidity of the oil passage portion 57. The thick wall portion 57A extends vertically along the supply passage 56A and the return passage 56B.

The first side wall 11 has a load absorbing portion 61 that is more readily deformable than the oil passage portion 57, and is located on one side of the oil passage portion 57. The rigidity of the load absorbing portion 61 is lower than the rigidity of the oil passage portion 57 so that the load absorbing portion 61 is more readily deformed than the oil passage portion 57. For example, the wall thickness of the load absorbing portion 61 is smaller than the wall thickness of the oil passage portion 57 so that the rigidity of the load absorbing portion 61 is lower than the rigidity of the oil passage portion 57. Here, the wall thickness of the oil passage portion 57 means the distance from the wall surface of the supply passage 56A or the return passage 56B to the outer surface of the oil passage portion 57. The wall thickness of the load absorbing portion 61 is selected to be thinner than any other parts of the oil passage portion 57.

Preferably, the load absorbing portion 61 extends to either side of the oil passage portion 57. Further, the wall thickness may be progressively reduced from the oil passage portion 57 to the load absorbing portion 61. Further, the load absorbing portion 61 may consist of a curved plate-shaped portion.

At least one rib 63 may project from the outer surface of the oil passage portion 57 so as to extend in the vertical direction and in the fore and aft direction. The rib 63 increases the rigidity of the oil passage portion 57. The upper end of the rib 63 may be connected to the flange 24. Further, the lower end of the rib 63 may be connected to the device mounting seat 52. By connecting the rib 63 to the flange 24 and the device mounting seat 52, the rigidity of the oil passage portion 57 is further increased. The projecting end of the rib 63 preferably protrudes laterally from the flange 24. Further, the rib 63 is preferably provided in the thick wall portion 57A of the oil passage portion 57. A pair of such ribs 63 are provided in the present embodiment, but three or more such ribs 63 may also be provided.

As shown in FIGS. 1 and 11, an auxiliary device 65 of the internal combustion engine 1 is supported on the oil pan 3. The auxiliary device 65 may be, for example, a compressor for an air conditioner, a generator, a water pump, or the like. The auxiliary device 65 is fastened to the oil pan 3 directly or via a bracket 66. In the present embodiment, the auxiliary device 65 is fastened to the first side wall 11 of the oil pan 3 via the bracket 66. The first side wall 11 has a plurality of bosses 68 to which auxiliary devices 65 are fastened on the outer surface thereof. At least two of the bosses 68 are laterally spaced apart from each other. As shown in FIGS. 5 and 11, the oil passage portion 57 and the load absorbing portion 61 are positioned between at least two of the bosses 68 along the lateral direction. The bracket 66 is fastened to the boss 68 with bolts or the like. The auxiliary device 65 is also fixed to the bracket 66 with bolts or the like. A part of the bracket 66 is fastened to the engine block 2.

In the present embodiment, the auxiliary device 65, which is a compressor in this case, is positioned in front of the oil passage portion 57 of the first side wall 11. The auxiliary device 65 is provided with a first abutting portion 65A projecting toward one of the ribs 63. The first abutting portion 65A faces one of the ribs 63 via a gap. Further, the auxiliary device 65 has a flange 24 and a second abutting portion 65B protruding toward the engine block 2. The second abutting portion 65B opposes the flange 24 and the engine block 2 via a gap.

Figure 8:
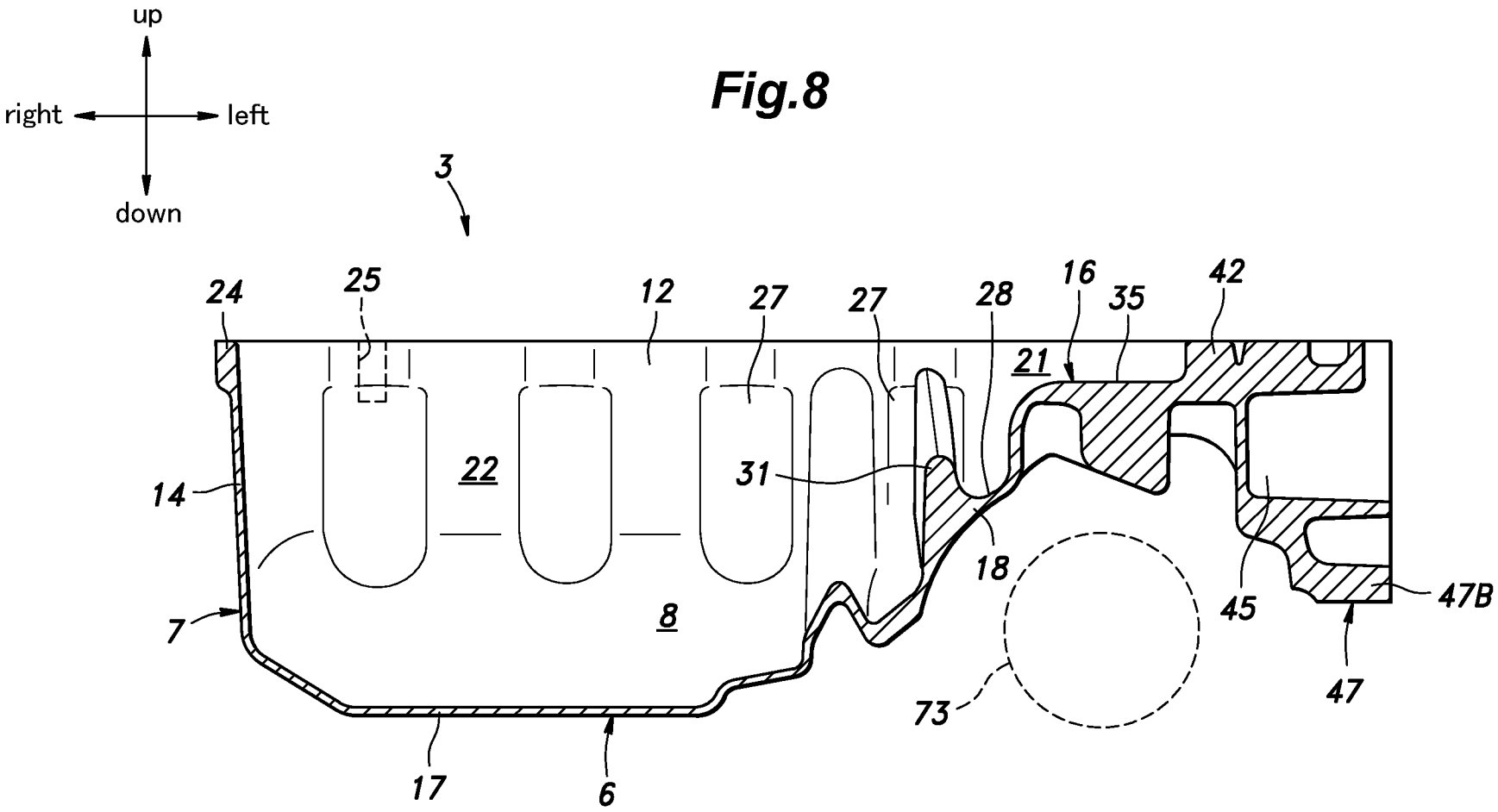
FIG. 8 is a sectional view of taken along line VIII-VIII of FIG. 3.

The device mounting seat 52 is positioned on the second side of the first side wall 11 with respect to the lateral direction. As shown in FIG. 8, an exhaust pipe 73 of the internal combustion engine 1 extends downward from the front side of the engine block 2, passes under the shallow bottom wall 16, and extends rearward. Thus, the exhaust pipe 73 is positioned directly under the shallow bottom wall 16 so that the device mounting seat 52 is spaced significantly away from the exhaust pipe 73 in the lateral direction.

Owing to the structure discussed above, when the auxiliary device 65 collides with the first side wall 11 due to a vehicle collision, the load absorbing portion 61 is deformed so as to absorb the load. As a result, the load is prevented from reaching the oil passage 56 so that damage to the oil passage portion 57 can be minimized. Since the load absorbing portion 61 has a smaller thickness than the oil passage portion 57, the load absorbing portion 61 is more preferentially deformed than the oil passage portion 57 so that the transmission of the load to the oil passage portion 57 can be reduced. Since the upper end of the oil passage 56 is positioned inwardly of the flange 24, the upper end of the oil passage portion 57 is protected from the auxiliary device 65 by the flange 24. Therefore, when the auxiliary device 65 collides with the oil pan 3 due to a vehicle collision or the like, damage to the oil passage 56 can be minimized.

When the auxiliary device 65 is pushed toward the oil pan 3 side due to a vehicle collision, the load from the auxiliary device 65 is transmitted to the first side wall 11 via the bosses 68. Since the load absorbing portion 61 is positioned between the bosses 68 and the oil passage portion 57, transmission of the load to the oil passage portion 57 can be minimized.

When the auxiliary device 65 collides with the oil pan 3, the first abutting portion 65A of the auxiliary device 65 comes into contact with the ribs 63 of the oil pan 3, and the second abutting portion 65B comes into contact with the flange 24 and the engine block 2. Therefore, the load applied from the auxiliary device 65 to the first side wall 11 of the oil pan 3 is reduced. Further, since the oil passage portion 57 has a higher rigidity than other parts of the first side wall 11, the oil passage portion 57 is less likely to be damaged, and before the oil passage portion 57 is displaced or deformed, the load absorbing portion 61 is deformed so that the load applied to the oil passage portion 57 is reduced. Even if the load absorbing portion 61 should be damaged, since the pressure of the oil in the oil pan 3 is lower than the pressure of the oil flowing through the supply passage 56A and the return passage 56B so that the splattering of the oil can be minimized. Further, since the oil passage portion 57 and the load absorbing portion 61 are laterally spaced from the exhaust pipe 73, even if oil should leak from the load absorbing portion 61, the oil is prevented from adhering to the exhaust pipe 73.

The present invention has been described in terms of a specific embodiment, but is not limited by such an embodiment, and can be modified in various ways without departing from the scope of the present invention. For instance, the load absorbing portion 61 is not limited to a thin wall portion having a smaller thickness than the oil passage portion 57, and may have other configurations. For example, the load absorbing portion 61 may be formed by curving or bending the first side wall 11 into an S shape or a bellows shape. Further, the first side wall 11 may be formed as a part of the engine block 2 instead of the oil pan 3.

The invention claimed is:

1. An oil pan for forming a lower end part of an internal combustion engine, comprising:

a bottom wall, and a side wall extending from a peripheral edge of the bottom wall, wherein the bottom wall includes a pair of first planar surface portions extending in a lateral direction and provided on either end of the bottom wall with respect to a fore and aft direction orthogonal to the lateral direction, and a curved surface portion recessed downward with respect to the first planar surface portions, wherein the bottom wall includes a shallow bottom wall provided on a first side with respect to the lateral direction, a deep bottom wall provided on a second side with respect to the lateral direction and offset downward from the shallow bottom wall, and a connecting wall provided between the shallow bottom wall and the deep bottom wall and inclined downward from the shallow bottom wall toward the deep bottom wall, the first planar surface portions and the curved surface portion being provided in the shallow bottom wall, wherein the shallow bottom wall includes a second planar surface portion provided on a first side of the curved surface portion with respect to the lateral direction, and positioned above a lowermost part of the curved surface portion and below a lowermost part of the first planar surface portions, wherein the first planar surface portions and the curved surface portion are connected to the connecting wall, and wherein the second planar surface portion is connected to the side wall.

2. The oil pan according to claim 1, wherein the curved surface portion has an arcuate cross section as viewed from the lateral direction.

3. The oil pan according to claim 2, wherein at least one of the first planar surface portions has a fore and aft width that progressively decreases toward a first side with respect to the lateral direction.

4. The oil pan according to claim 3, wherein the side wall includes a first side wall provided in a front side part of the bottom wall, and a second side wall provided in a rear side part of the bottom wall, at least one of the first side wall and the second side wall being slanted inward toward the first side with respect to the lateral direction.

5. The oil pan according to claim 4, wherein the side wall is provided with a fastening portion on the first side thereof with respect to the lateral direction for fastening a transmission device or a drive unit thereto.

6. The oil pan according to claim 1, wherein at least one of the first planar surface portions is inclined downward toward the curved surface portion.

7. The oil pan according to claim 1, wherein the curved surface portion is provided with a reinforcing structure that is recessed radially outward of the curved surface portion.

8. The oil pan according to claim 7, wherein the reinforcing structure extends laterally and is connected to the connecting wall.

* * * * *